United States Patent [19]

Cote-Petit et al.

[11] 4,197,722

[45] Apr. 15, 1980

[54] KNITTING MACHINE

[75] Inventors: Jackie Cote-Petit, Pontarlier, France; Fritz Kohler, Couvet, Switzerland

[73] Assignee: Edouard Dubied & Cie. Societe Anonyme, Couvet, Switzerland

[21] Appl. No.: 17,237

[22] Filed: Mar. 5, 1979

[51] Int. Cl.[2] ..... D04B 7/00; D04B 15/60

[52] U.S. Cl. ..... 66/75.2

[58] Field of Search ..... 66/75.2, 231, 233, 218, 66/219, 220

[56] References Cited

FOREIGN PATENT DOCUMENTS

| | | | |
|---|---|---|---|
| 1962787 | 7/1971 | Fed. Rep. of Germany | 66/75.2 |
| 2021742 | 11/1971 | Fed. Rep. of Germany | 66/75.2 |
| 2137680 | 3/1972 | Fed. Rep. of Germany | 66/75.2 |
| 2222408 | 11/1972 | Fed. Rep. of Germany | 66/75.2 |

*Primary Examiner*—Ronald Feldbaum

*Attorney, Agent, or Firm*—Lewis H. Eslinger

[57] ABSTRACT

A knitting machine including a plurality of needles extended by two superimposed arms one of which, bearing a butt, is flexible, while the other one extends the support face of the needle. The upper arm is embedded by the action of a cam on the butts of a needle-latch and held in the embedded position by an electromagnetically controlled selection of a selector element in order to put the needle in the row being processed out of action, or to hold it temporarily in its embedded position by causing one or several press blocks to act on one or several tracks formed by the alignment of preselected butts in either position of the needle-latch in order to tuck stitches upon each pass and for each system of a knitting carriage.

7 Claims, 4 Drawing Figures

KNITTING MACHINE

The present invention relates to flat knitting machines and in particular to flat knitting machines having needle preselection capability.

An object of the present invention is to provide a knitting machine having an improved needle preselection capability including electromagnetically controlled needles and stitch transfer.

Flat knitting machines having needle preselection capability are already known from the prior art. For example, German patent DE-PS 1 962 787 describes a knitting machine in which the plates are integrally connected to the needles by means of a ball and socket joint. The plate butts are positioned either embedded in the needle bed by plate-presses, of which there are several for each needle so that the butts are out of reach of the cam boxes, or in elevated positions where they are driven along by the cams. The plates are embedded so that the counterbutt of the plate is located in the groove of the needle trick in order to prevent the needle from continuing to slide in the trick. The multiplicity of presses and the complicated shape of the needle bed under the plate butts constitute serious drawbacks as regards size and manufacturing. Such a construction requires needle beds with inserted partitions and this arrangement makes the needle beds considerably wider.

Swiss patent CH 569 118 describes a flat knitting machine with needle preselection and stitch transfer, comprising needles, flexible key bolts and key bolt press blocks in which the flexible key bolt is independent of the needle and in which retractable cams, starting in front, as seen in the direction of travel of the butts, and extending over at least part of the ascending ramps of the cam box cams, act on the butts of the flexible key bolts. This machine has given full satisfaction; however, it has the drawback that needle selection is limited to the possible combinations offered by preselection of the flexible key bolt butts in the various paths or ways, i.e. on the crossing path of one series of key bolt press blocks or another. Another drawback which becomes increasingly noticeable as knitting speeds increase resides in the fact that the butts of the needles which are out of action emerge continuously from the needle bed and, consequently, find themselves on the crossing path of the lowering cams, this resulting in useless impacts on the butts, leading to breakage of needle hooks and harmful stresses of the stitch contained in a hook, due to the movement of the needle in its trick.

Swiss patent CH 494 298 describes an electromechanically controlled needle selection device of a knitting machine in which each key bolt is individually and kinematically integral with one of the arms of the needle-latch held in the operating position by means of a restoring force, the other arm cooperating with a sliding member assigned to each latch and being capable of occupying two extreme end positions in one of which it is on the pathway, with the position of the sliding member being determined by a pair of opposing electromagnets assigned to each selecting head. The pole shoes of the electromagnets are followed by diverging ramps against which the sliding members are held magnetically in either extreme end selection position and in which a cam is provided to cock the needle latches and release them at the time of selection, the needle latches being held by the sliding member or not. This selection principle has also been used successfully in circular knitting machines.

The purpose of the invention is to create a simple flat knitting machine combining the selection advantages of a conventional key bolt machine with those of electromagnetically controlled selection, also called "on the wing" selection, to eliminate the aforementioned drawbacks while at the same time making possible selective knitting and stitch transfer at any speed to increase needle selection and preselection possibilities and to limit selection members as much as possible while retaining a reasonable number of needle selection possibilities in the stitch-tucking position.

The attached drawing shows, by way of example, an embodiment of the flat knitting machine in accordance with one embodiment of the present invention.

Figure 1:
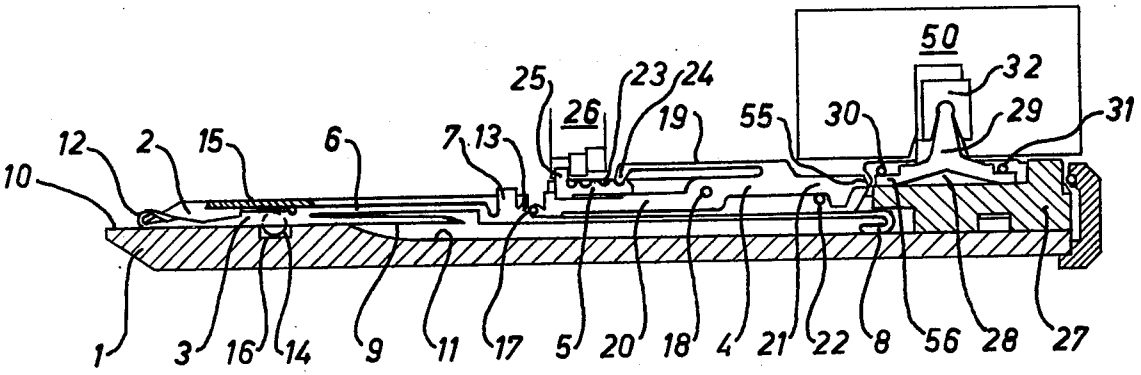
FIG. 1 is a side sectional view of a needle bed constructed in accordance with the present invention.

Referring now to the drawings, the needle bed 1 shown in FIG. 1 is one of the needle beds of a flat knitting machine which generally comprises two needle beds arranged in pairs in the shape of a roof or of an inverted "V". The needle bed 1 includes a plurality of tricks 2 positioned parallel with each other and in which a needle 3, a two-arm lever 4 and a tuck selector 5 are located. Needle 3 has two arms or stems, i.e. and upper arm 6 having a butt 7 and a gliding foot 8, and a lower arm 9 which forms the base of the needle. Trick 2 is formed deeper towards the rear of the bed, i.e. on the right-hand side of FIG. 1, and thus defines two sliding faces 10, 11. Lower arm 8 and needle 3 slide on face 10 and gliding foot 8 slides on face 11. Needle 3 also includes a hook 12 and a retaining nose 13.

Lower arm 9, which is used to ensure proper needle support in the maximum advance position of needle 3, i.e. the stitch transfer position, is advantageously used as the braking element of the needle in its trick. Within the scope of this embodiment of the invention, it moves, for each movement of needle 3, between the turns of a brake spring 14 located under a needle cover strip 15 and in a groove 16 provided in needle bed 1, perpendicular to tricks 2. Another braking principle, not shown, could consist in laterally deflecting lower arm 9 with respect to upper arm 6, this arrangement resulting in a lateral braking action between the partitions delimiting a trick 2.

Another advantage of lower arm 9 resides in the fact that by increasing the mass of needle portion 3 located between hook 12 and butt 7, it considerably decreases, in the portion concerned, the frequency of vibrations which are due to an impact on butt 7.

A permanent taking out of action of the needle is achieved by embedding butt 7 in trick 2; in that position retaining nose 13, which passes under a wire 17, will hold the needle in this position as long as no manual displacement has been effected.

Two-arm lever 4 is mounted for pivotal movement on an axle 18 integral with needle bed 1. It comprises an upper arm or stem 19 and a lower arm or stem 20 which define a fork in which tuck selector 5 is clamped. Lower arm 20 rests against upper arm 6 of needle 3, between nose 13 and foot 8. Two-arm lever 4 also includes a feeler 21, diametrically opposite the fork with respect to pivoting axle 18. A limiting wire 22, integral with needle bed 1, delimits an extreme end position of the two-arm lever.

Tuck selector 5 is provided with notches 23 which, by means of a holding action on the part of a nose 24 of arm 19 in either of them, determine four different positions of said tuck selector with respect to two-arm lever 4, i.e. to selectively locate the butt 25 in one of four tracks or way 51, 52, 53, or 54. Tuck selector 5 also includes a butt 25 located to cooperate selectively with fixed vertical cams 26 as described below.

An auxiliary needle bed 27 is mounted on needle bed 1 in the extension of tricks 2. The auxiliary needle bed has a plurality of grooves 28 formed therein, in which a lower Jacquard selector 29, held back vertically by wires 30, 31, integral with auxiliary needle bed 27, slides. An upper Jacquard selector 32 is mounted for pivoting on lower Jacquard selector 29.

Figure 2:
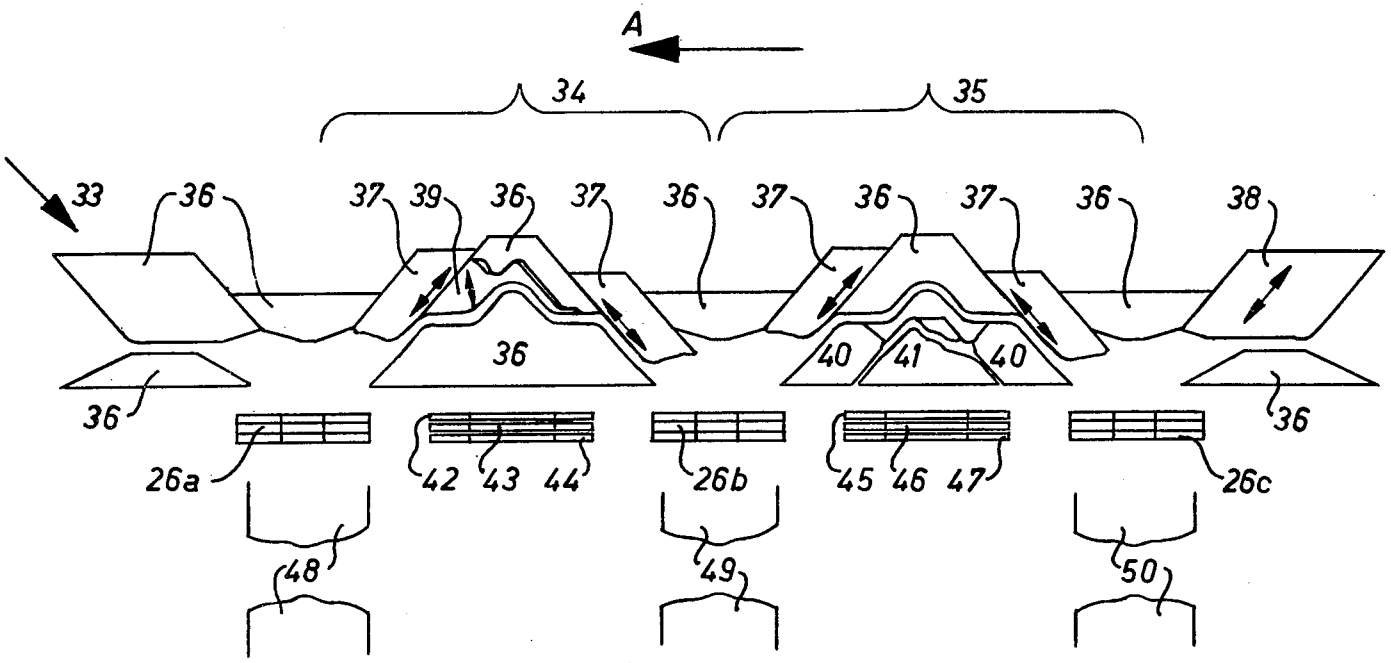
FIG. 2 is a diagrammatic plan view of a knitting cam box including the vertical cams and the selecting heads which are integral with a knitting carriage as used in the device of the present invention.

A cam box 33, shown schematically in FIG. 2, is associated with each needle bed 1 above needle butts 7. It consists of a first knitting system 34 and a second knitting system 35. Each cam box 33 is provided with fixed cams, uniformly designated by reference number 36 in FIG. 2. The lowering cams, designated by reference number 37, as well as alignment cam 38 and stitch transfer cam 39 are movable in a plane parallel to the cam box in a known manner to cooperate with butts 7 of the needle. Only raising cams 40 and stitch transfer cams 41 are movable in a plane perpendicular to the cam box. They may be selectively placed in a remote or close position with respect to their needle bed in a known manner. Such positions are changed only for stitch transfer work.

Two fixed vertical cams 26 are assigned to each knitting system. They are fixed vertical cams **26*a* and 26*b* for knitting system 34 and fixed vertical cams 26*b* and 26*c* for knitting system 35. Fixed vertical cam 26*b*** is located to cooperate with both knitting systems.

In addition, movable vertical cams are assigned to each knitting system. Vertical cams 42, 43, 44 are assigned to knitting system 34, and vertical cams 45, 46, 47 are assigned to knitting system 35. Fixed vertical cams **26*a–c* and groups of movable vertical cams 42–44, 45–47** are located one behind the other, on one and the same path or way when viewed in the direction of movement of the cam boxes.

Each knitting system is directly preceded, when viewed in the direction of advance of the cam boxes, by an electromagnetic selecting head, as shown in FIG. 2. These selecting heads have opposed pole shoes followed by diverging ramps for magnetically holding and moving the Jacquard selectors in the grooves 28 between two extreme positions in the conventional manner. When the cam boxes move in the direction indicated by the arrow A, selecting head 48 precedes knitting system 34 and selecting head 49 precedes knitting system 35. In case of movement in the opposite direction, selecting head 50 precedes knitting system 35 and selecting head 49 precedes knitting system 34. Selecting head 49 is provided to cooperate with both knitting systems 34, 35, as a function of the direction of travel of the cam boxes. Selecting heads 48, 50 are also placed in action, after the knitting system, to arrange upper Jacquard selectors 32 in a given position.

Figure 3:
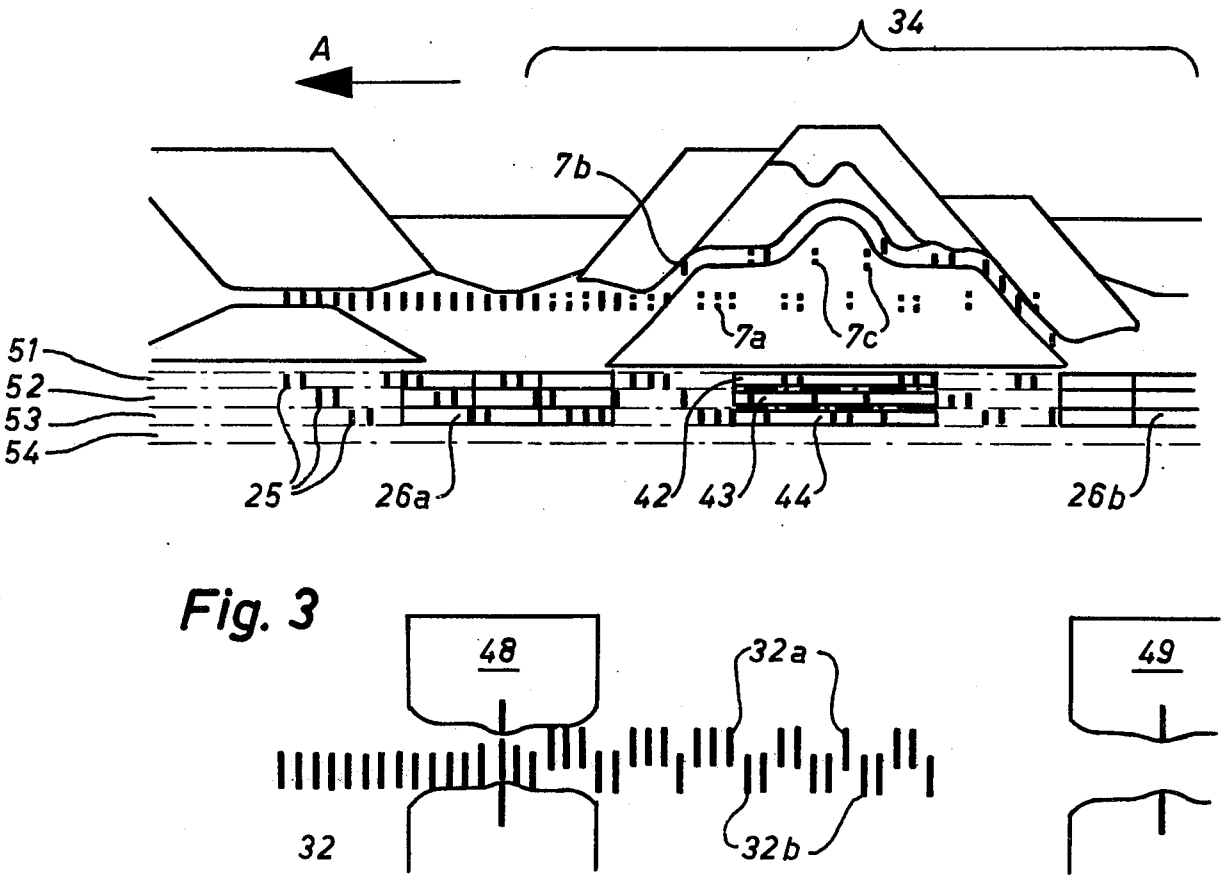
FIG. 3 is an illustration of a portion of the cam box of FIG. 2, on a larger scale, showing a knitting selection step.

Referring now to FIGS. 1 and 3, the needle selection principal shall now be described, in the process the cam boxes move in the direction indicated by arrow A of FIG. 2 and selectors 32 are in an "In action" position. They have been arranged in this manner by selecting head 48 at the time of the preceding pass affected by the cam boxes in an opposite direction. Butts 25 of tuck selectors 5 (FIG. 1) are preselected manually on either track 51, 52, 53, 54, by means of a holding action by nose 24 in one of the notches 23. Fixed vertical cam **26*a* presses, in opposition to a spring effect exerted by the upper arm or stem 6 of needle 3, against all butts 25 that are on its path, i.e. against all butts arranged in tracks or ways 51, 52 and 53. Consequently, each two-arm lever 4 revolves about its axle 18, and nose 55 of the two-arm lever is located above end 56 of lower Jacquard selector 29**.

By known means, not shown, selecting head 48 positions upper Jacquard selectors 32 in two distinct positions, selectors **32*a* being "Out-of-action" and selectors 32*b* being "In action". Once the selection has been established, fixed vertical cam 26*a* is gone beyond. Under the action of upper arm or stem 6, the two-arm levers 4 tend to return to their position shown FIG. 1. The ends 56 of lower Jacquard selectors 29, whose upper Jacquard selectors 32 are selected at 32*a*, will be on the path of nose 55. The two-arm lever 4 will not end its stroke and butt 7 will remain embedded in needle bed 1, i.e. it will not emerge from the needle bed and will thus not be taken over by a cam of selecting head 34. Such a needle is temporarily "Out-of-action"; it is, for example, those whose butts are referenced by index 7*a* in FIG. 3**.

If nose 55 of two-arm lever 4 meets no lower Jacquard selector 29 on its path, it assumes the position in accordance with FIG. 1, and the butt of the corresponding needle will be taken over by a cam of knitting system 34, such as butt **7*b*, for example. At that very time, a second selection takes place, in order to determine whether the needle is to effect a full ascension to form a stitch, or a partial ascension in thread tucking position. Such a selection is established by means of placing a movable vertical cam into action. In the example shown, vertical cam 43 is placed into action. In accordance with the same principal as that of fixed vertical cam 26*a*, it presses against butts 25 that are on its path, hence in track or way 52. The butt of the corresponding needle is temporarily embedded and assumes, for example, position 7*c* of FIG. 3. Released by vertical cam 43 this butt will be placed back in the cam path and pulled down by a lowering cam. The same process takes place in connection with the next knitting system, in this particular case, knitting system 35, by means of fixed vertical cam 26*b*, selecting head 49, and movable vertical cams will place all upper Jacquard selectors in action for the carriage's next pass. This will result in the needles being fully freed by causing all butts 7 to emerge above the needle bed. Such an arrangement facilitates the work of alignment cam 38** which makes it possible, in a low position, to present the needles to a known latch-opening device, not shown, thus permitting the transfer of stitches to empty needles.

The same selection principle is used in knitting system 35. Knitting in the direction opposite that indicated by arrow A takes place, by analogy, in the same manner.

Figure 4:
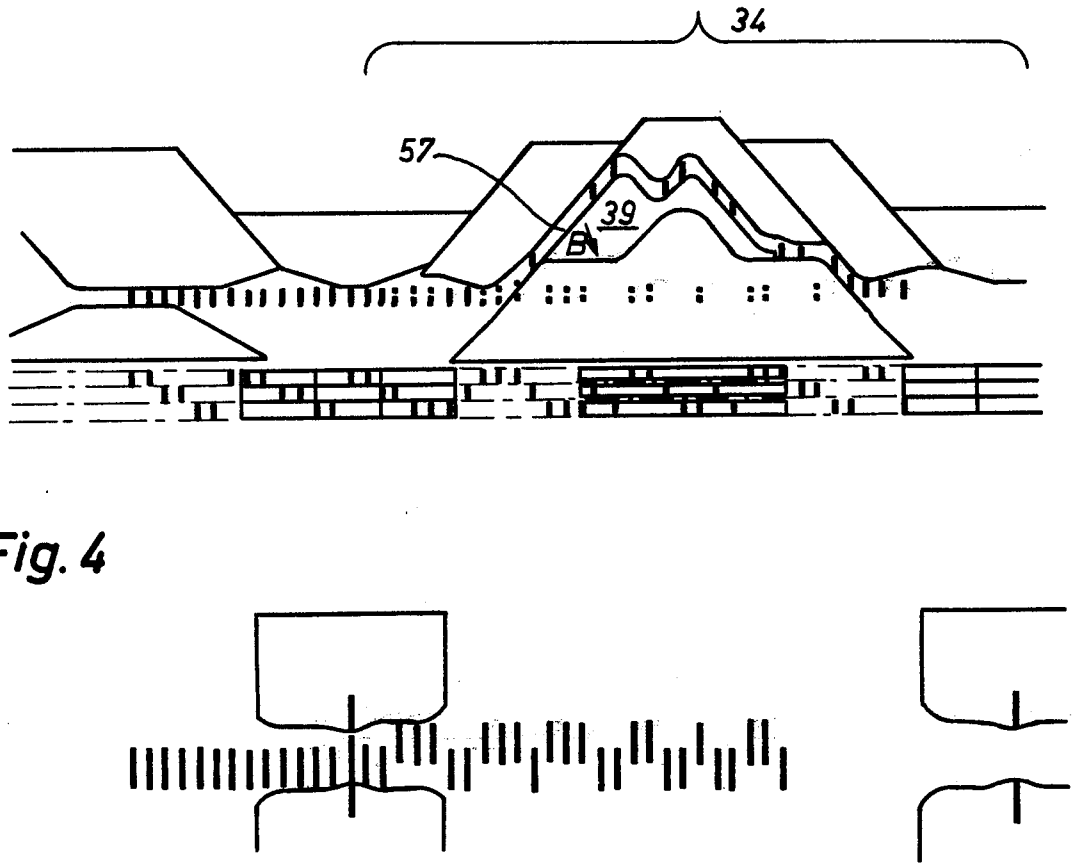
FIG. 4 is a view similar to FIG. 3, showing a stitch transfer selection.

The same selecting members and the same principle are also used for stitch transfer, as shown in FIG. 4. Stitch transfer cam 39 has been moved in the direction indicated by arrow B to form transfer channel 57. In the event of a stitch transfer from the rear needle bed to the front needle bed, stitch transfer cam 41 FIG. 2 of knitting system 35 will be placed in action, and raising cams 40 will be placed out of action. By means of moveable vertical cams 45, 46, 47, used to select a stitch tucking, we are able, in accordance with the same principle, to transfer stitches to selected needles, which makes it possible to avoid having to raise all the needles in receiving position. Tuck way 54 of FIG. 3 affords an additional selection possibility in which butts 25 will never be embedded or retracted. Thus the corresponding needles will be continuously in action and will be raised only in the stitch-forming position. The selecting head will have no effect since the end 56 of lower Jacquard selectors 29 (FIG. 1) will come to rest against nose 55 of the corresponding two-arm lever. Consequently, this makes it possible, independently of the electromagnetically controlled selection, to maintain the needles in a permanent "In action" position.

Thus, as a result of the structure of the present invention, the knitter has available to him a machine which will allow him, for one and the same manual preselection of the needles intended to tuck a stitch, to knit an infinity of variants resulting from the predominance of the electromagnetic selection of the needles which are out of action on the basis of the preselection resulting from the distribution of the tuck selectors in either of tuck ways 51, 52, 53.

Although an illustrative embodiment of the present invention has been described herein with reference to the accompanying drawings, it is to be understood that various changes and modifications may be effected therein without departing from the scope a spirit of this invention.

We claim:

1. A flat knitting machine with needle preselection, electromagnetically controlled needles and stitch transfer, comprising a pair of needle beds arranged in an inverted V shaped configuration and having tricks formed therein; needles and selectors having butts thereon received in said tricks, said butts being adapted to be positioned level with or above their associated needle bed and said selector butts being adapted to be positioned at different levels with respect to their associated needle bed; a knitting carriage including cam box means for moving said needles in said tricks, said cam box means including vertical cams for moving said needle and selector butts to different levels with respect to the needle bed, a sliding member on said bed associated with each needle and electromagnetic selection control means cooperating with said sliding member for moving the sliding member between two extreme end positions, a pair of opposing electromagnets defining said extreme end positions and having pole shoes assigned to each selection means, said pole shoes of such electromagnets being followed by diverging ramps against which said sliding members are magnetically held in either end position, and fixed vertical cams acting on two-arm levers and slackening the said two-arm levers perceptibly after the selection; said needles having two superimposed upper and lower arms, said upper arm having a butt which is adopted to be embedded in the needle bed by the action of a two-arm lever on the upper arm and returned to its emergent position by the flexibility of said upper arm, the lower arm being an extension of the support base of the needle in its trick, said upper arm having a gliding foot resting on a slide face located in an extension of its associated trick, and said two-arm lever having a tuck selector mounted thereon which is adopted to be located in different positions in order to permit manually-controlled needle selection; said cam box means having at least one knitting system means including at least one movable vertical cam, said knitting system means, viewed in the direction of movement of the knitting carriage, being preceded by a fixed vertical cam and by said electromagnetic selecting means and having a movable cam (39) in a plane which is parallel to the plane of the cam box, for defining a butt cam slot thereby to transform a knitting system into a stitch transfer system for needles containing stitches to be transferred; said knitting system means including cams movably mounted therein for movement in a plane which is perpendicular to the plane of the cam box to transform a knitting system into a stitch transfer system for needles intended to receive stitches; said fixed vertical cam and said movable vertical cams being located alternately behind each other on one and the same butt tracks of the tuck selectors, said knitting system means including a movable alignment cam in a plane which is parallel to the plane of the cam box.

2. A knitting machine as defined in claim 1, including needle-braking means cooperating with the lower arm of the needle for braking movement of the needle.

3. A knitting machine as defined in claim 2, wherein said braking means comprises a spring housed in a groove located perpendicular to the needle tricks and which emerges partially in said needle tricks.

4. A knitting machine as defined in claim 1, wherein the tuck selector has four notches formed therein defining three tricks for the manual preselection of the needles intended to tuck a stitch and a fourth track for the manual preselection of the needle intended to form a stitch or to prevent an action by the vertical cams on the tuck selector when the needle is taken out of action manually.

5. A knitting machine as defined in claim 1, including a fixed vertical cam and a selecting head cooperating with either knitting system, depending on the direction of movement of the knitting carriage.

6. A knitting machine as defined in claim 1, wherein electromagnetic selecting head means preceding the first knitting system in one direction of movement and located behind the last knitting system when there is movement in an opposite direction is made operational so as to locate all needles in action behind the knitting carriage.

7. A knitting machine as defined in claim 1, wherein the alignment cam is mounted to move in a plane which is parallel to the plane of the cam box between two distinct postions making it possible to align the needles in a so-called "level-to-the jack/level with the knocking over bits" position or in a preferential position opposite a needle latch-opening device.

* * * * *